US007120976B2

(12) United States Patent
Pester et al.

(10) Patent No.: US 7,120,976 B2
(45) Date of Patent: Oct. 17, 2006

(54) PROCESS AND APPARATUS FOR LAYING FIBER BANDS OF FILAMENTS

(75) Inventors: Wolfgang Pester, Chemnitz (DE); Gottfried Roth, Chemnitz (DE); Frank Schubert, Chemnitz (DE)

(73) Assignee: Karl Mayer Malimo Textilmaschinenfabrik GmbH, Chemnitz (DE)

( * ) Notice: Subject to any disclaimer, the term of this patent is extended or adjusted under 35 U.S.C. 154(b) by 39 days.

(21) Appl. No.: 11/072,449

(22) Filed: Mar. 7, 2005

(65) Prior Publication Data

US 2005/0198792 A1 Sep. 15, 2005

(30) Foreign Application Priority Data

Mar. 11, 2004 (DE) ..... 10 2004 012 305

(51) Int. Cl.
*D04B 23/12* (2006.01)
*B32B 5/00* (2006.01)

(52) U.S. Cl. ..... 28/102; 28/100; 66/84 A

(58) Field of Classification Search ..... 28/100, 28/101, 102, 172.1, 184, 185; 66/84 A, 84 R, 66/190, 192, 203, 125 R
See application file for complete search history.

(56) References Cited

U.S. PATENT DOCUMENTS 3,756,043 A * 9/1973 Kemter ..... 66/84 R
4,380,913 A * 4/1983 Wilkens ..... 66/84 A
4,395,888 A * 8/1983 Wilkens ..... 66/84 A
4,677,831 A * 7/1987 Wunner ..... 28/100
4,877,470 A * 10/1989 Krueger ..... 28/100
5,111,672 A * 5/1992 Gille et al. ..... 28/102
5,308,424 A * 5/1994 Sasaki et al. ..... 156/178

FOREIGN PATENT DOCUMENTS

| | | |
|---|---|---|
| DE | 42721 | 6/1999 |
| DE | 21341 | 11/2001 |
| DE | 49161 | 4/2003 |
| DE | 14140 | 10/2003 |
| DE | 07317 | 11/2003 |
| DE | 12534 | 8/2004 |

OTHER PUBLICATIONS

English Language Abstract of DE 10149161.
English Language Abstract of DE 197421721.

* cited by examiner

*Primary Examiner*—Amy B. Vanatta
(74) *Attorney, Agent, or Firm*—Greenblum & Bernstein, P.L.C.

(57) ABSTRACT

Process and apparatus for laying fiber bands of filaments by changeably moveable weft or diagonal layers to form fiber arrangements stretched in different laying directions between two transport chains having guide hooks and retainer needles. Fiber bands are spread individually, guided by guide elements for forming a direction change fold, such that strands of each direction change fold are fixed in gaps between guide hooks. Apexes of direction change folds spread out by the guide elements execute racking and are hanged and fixed in a row of densely arranged retainer needles. Upper strands of direction change folds forming between retainer needles and guide elements of weft or diagonal layers are spread horizontally and guided under tension by a stitch spreader moved from outside inwards. The instant abstract is neither intended to define the invention disclosed in this specification nor intended to limit the scope of the invention in any way.

20 Claims, 3 Drawing Sheets

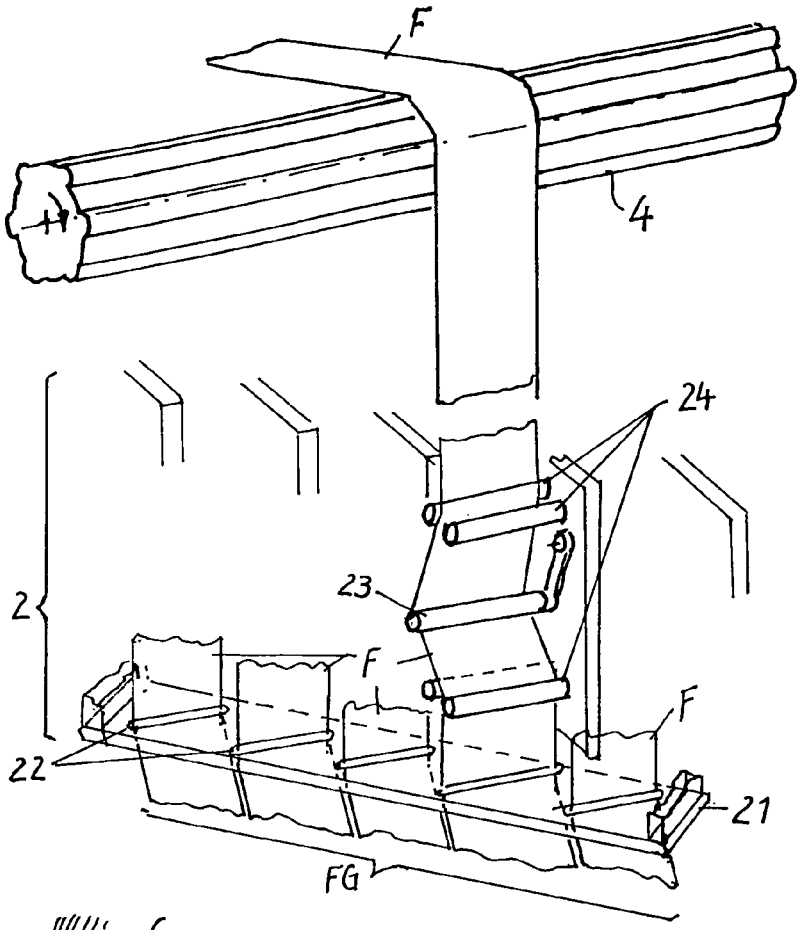
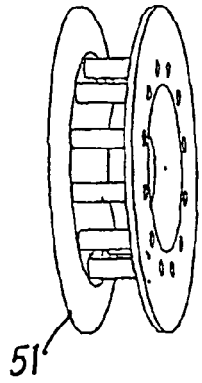
Fig.9
Fig.6
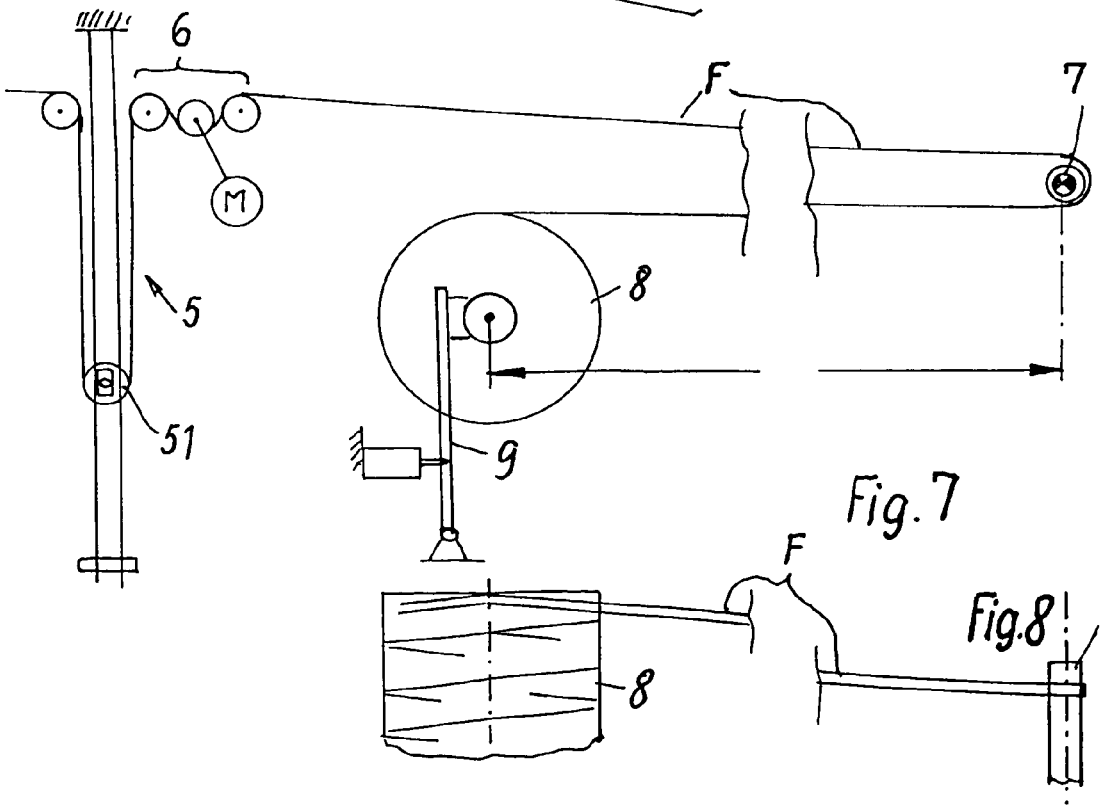
Fig.7
Fig.8

PROCESS AND APPARATUS FOR LAYING FIBER BANDS OF FILAMENTS

CROSS-REFERENCE TO RELATED APPLICATIONS

The present application claims priority under 35 U.S.C. §119 of German Patent Application No. 10 2004 012 305.5-26, filed on Mar. 11, 2004, the disclosure of which is expressly incorporated by reference herein in its entirety.

BACKGROUND OF THE INVENTION

1. Field of the Invention

The invention relates to a process and apparatus for laying fiber bands of filaments by changeably moveable weft layers or diagonal layers to form fiber arrangements stretched in different laying directions between two transport devices equipped with guide hooks and retainer hooks and thus conveyed to a pretreatment station. The endless flat fiber bands are spread individually, and guided by guide elements of the weft layer or diagonal layer aligned perpendicular to the preset laying direction crosswise over both transport chains and deposited. Each of the fiber bands is guided by a guide element that crosses the row of guide hooks of the transport chain to respectively form a direction change fold having a lower strand, an upper strand and an apex, such that the fiber band is inserted into retainer elements.

2. Discussion of Background Information

A method of the type mentioned was proposed through DE 101 49 161 C2. The sheet of fiber bands is guided diagonally over the transport chains with the aid of a weft layer or a diagonal layer. The guide elements for the fiber bands are aligned perpendicular to the movement direction of the weft layer and arranged in a line next to one another parallel to the transport chains. The transport chains have two rows of hooks arranged spaced at a distance from one another. The guide hooks are located adjacent to the fiber arrangement. They have perpendicular needles closely adjacent to one another with the tip pointing upwards. Outside this row of guide hooks there is another row with retainer needles pointing upwards and outwards. These are likewise arranged very densely.

The guide elements on the weft layer or diagonal layer are vertically fixed. In the direction change phase a so-called fold tensioner is inserted behind the guide element of the weft layer, which fold tensioner guides the upper and lower strands of the direction change fold separately from one another at the apex of the same until both strands are transferred to the row of guide hooks again after racking of the upper strand is completed by a racking grid swung in from above. While racking is executed, the fibers of the direction change fold are stretched and collected by a so-called loop tensioner and transferred to the row of retainer hooks in the form of a rope.

Due to the large number of tools involved in the operation, this procedure requires a very high control expenditure. The desired effect, namely to achieve a really gap-free form of the fiber arrangement, is achieved only with reservations. The working speed remains limited and is unsatisfactory. With a change in the width of the fiber bands or with the change of alignment of the fiber band sheet between the transport chains, the work elements always have to be structurally adapted to the new conditions. The associated expense is high.

With DE 197 42 721 C1 a method and a device for laying and positioning weft thread sheets is known in which the transport chains are likewise equipped with guide hooks and needle-shaped retainer hooks. The weft thread layer is lowered in connection with a presser rail outside the retainer hooks under the tips of the same after it has executed a first racking. After completion of a further final racking under the tips of the retainer hooks, the weft thread guide is raised again and lays the weft thread sheet, which is now stretched between the retainer hooks and the weft thread guide, at a predetermined point into the row of the guide hooks of the transport chains.

However, with this mode of operation and this device only weft thread sheets, the weft threads of which are not laterally connected to one another can be reliably hooked into the transport chains. This mode of operation is not suitable for fiber bands of, e.g., carbon or glass filaments, in which the filaments are held against one another in a predetermined defined position, namely forming a band, by adhesive materials. During racking the cross sections of the fiber band are raised in an uncontrolled manner, so that a uniform hooking, in particular of the upper strand, into the row of guide hooks cannot be guaranteed. In addition, during the racking of a fiber band within a guide element on the weft layer, the band is deformed into a rope. There is no possibility of spreading out this rope again before transfer to the guide hooks. Gaps of irregular width would develop in the border area of the arrangement which would be considered to be substantial quality defects. This mode of operation is therefore not suitable for laying fiber bands of filaments.

DE 100 21 341 A1 describes a similar device. Here additional band fixing systems, the design and operating method of which remain unclear, are assigned to the weft layer instead of to the presser rails. These band fixing systems evidently avoid pushing together the thread sheet during the racking behind the retainer hooks. It is not possible to feed fiber bands of filaments with this arrangement. The swiveling of the strips carrying the guide elements would repeatedly lead to rope formation. Gap-free arrangements of fiber bands cannot be produced in this manner.

Another device was disclosed by DE 102 07 317 C1. The weft thread guide of the weft layer or diagonal layer, which weft guide is aligned parallel to the row of guide hooks, has guide elements, the guide surfaces of which are aligned parallel to the row of guide hooks. The weft thread guide does not perform any movement in the racking direction. The racking is carried out by a standard racking grid which is assigned in the known manner to the retainer needles pointing outwards and upwards.

A guided band is deformed into a rope during racking within the guide elements in the weft layer through the movement of the racking grid—independent of the weft layer. This rope is subsequently inserted into the row of guide hooks and forms the dreaded gaps.

In a further development of DE 101 49 161 C2 discussed initially, the unpublished DE 103 12 534 proposes a modified device with which, i.e., the transfer of the rope-shaped apex of the direction change fold from the fold tensioner to the retainer hooks is to be improved in that a type of fitting (retainer needles distributed on a surface) is provided instead of the row of retainer hooks.

This did not achieve the desired success, either. The device and the control thereof are similarly expensive as was shown in reference to DE 101 49 161 C2. Loose fibers from the fiber band of the direction change fold are also in part guided into the arrangement and undesirable distortions thus occur there.

In another variant of this cited document not published earlier, guide grids that can be activated in a follow-on manner are assigned to the weft layer with its guide elements, which guide grids laterally fix the position of the fiber bands of the upper strand of the direction change fold and align it vertically in a plane parallel to the tips of the guide hooks. The function of the loop holder is here taken over by the fold tensioner which can be pivoted about an axis. This fold tensioner transfers its direction change fold respectively to one individual retainer hook per fiber band. This method of operation is likewise unsatisfactory, since the direction change fold is guided in an uncontrolled manner, in particular during the transfer of the direction change fold from the fold tensioner to the individual retainer hooks. The release of this fold by the fold tensioner leads to the relaxation of fibers and fiber bands in the arrangement.

In view of these seemingly insoluble difficulties in hanging endless fiber bands of filaments into the hooks of the transport chains, attempts have been made to align previously trimmed fiber bands under tension over the two transport chains and to hang them into the rows of the guide hooks of the transport chains. The free ends of the fiber band sections were brought—directed downwards—into a further clamp on the transport chain that was opened again at each laying arrangement before new end sections were inserted. This method of operation has also proven to be very difficult to control. The fiber band filaments not directly connected to the clamp surfaces of the clamps could not be held and tensioned securely. The interaction of the clamps with different functions cannot be controlled under industrial conditions at sufficiently high speed.

SUMMARY OF THE INVENTION

The present invention proposes a method and a device for laying endless fiber bands of filaments which with simple technical elements control the distortions of the fiber band in the direction change fold such that both strands can be laid in the hooks of the transport chains under defined conditions and the position and the tension of the inserted fiber bands between the transport chains are maintained.

According to the invention, the method is performed in a surprisingly simple way.

The first important advantage of this solution is that the fiber band sections of the thread arrangement between the transport chains and the fiber band sections in the area of the direction change fold are separated from one another regarding their tension behavior through the reliable fixing of the fibers of the fiber bands in guide hooks with close gaps. A temporary loosening of individual fibers in the area of the direction change fold does not automatically lead to a loosening of the fibers in the thread arrangement.

The second important advantage of the new method is that in particular the upper strand of the direction change fold, after the apices were inserted into the retainer hooks directly by the weft layer or the diagonal layer, can be stretched and guided by the simple stitch spreader such that raising this upper strand before hanging in the guide hooks is avoided. Any excessive fiber lengths are kept near to the apex area of the direction change fold. At the same time the band cross sections in the area of the guide elements displaced at one side during racking are distributed over the entire guide area again by the action of the stitch spreader so that the upper strand of the direction change fold can be fully spread out and fed to the guide hooks under tension.

The number of tools necessary for this method has been substantially reduced. No individually controllable fold tensioners, guide combs or loop holders are necessary. The arrangements produced according to this method can also be produced, where necessary, free of gaps in a targeted and reliable manner.

Through modification of the method, it is achieved that a single stitch spreader can be used for several fiber bands fed next to one another with an uninterrupted spreader edge. The design and control of the stitch spreaders is considerably simplified.

The design of the method leads to greater security in that the excess fiber sections in the area of the direction change fold are kept away from the area of the upper strand that will be fed to the guide hooks for hanging.

The design of the guide hooks renders possible the reliable separation between the band sections in the arrangement and the band sections of the direction change fold. A high uniformity of the arrangement is achieved in particular in that—in the threadline in front of the guide elements—the individual fiber bands are stretched and guided independently of one another and that the guide surfaces of these dowel pins and guide pins are adjusted to the direction of the guide elements.

The device for carrying out the stated method is simple and clear and, compared to known devices, provides important simplifications regarding the tools and the necessary precision of the control movements.

The design of the double row of guide hooks and the row of retainer hooks ensures particularly good clamping properties with laying and removing the fiber bands being free of malfunctions at the same time.

The embodiment of the weft layers and diagonal layers serves in particular the modification of the method in which each individual fiber band, independent of the other fiber bands of the group, is guided in the feed direction in front of the respective guide elements on the diagonal layer or weft layer across the width of the fiber bands under uniform tension and parallel to the respective guide element.

The design of the creel reduces the likelihood of twisting of the bands accidentally occurring in the threadline between the bobbin and the weft layer or the diagonal layer. Such twisting would lead to arbitrary irregularities in the arrangement in the form of gaps of limited length.

The use of the conveyor rollers or guide rollers or also tension rolls in the feed of the fiber bands prevents individual filaments from winding on these rollers and supports the spread-out guiding of the fiber bands.

The invention is directed to a process for laying fiber bands of filaments to form fiber arrangements via changeably moveable weft layers or diagonal layers composed of fiber bands that are stretched in different laying directions between two transport chains equipped with guide hooks and retainer needles. The process includes individually spreading the fiber bands, which are guided by guide elements of the weft layer or diagonal layer, crosswise over both transport chains, depositing the fiber bands onto the transport chains, and forming into each of the fiber bands a direction change fold that has a lower strand, an upper strand and an apex. A start of the lower strands and an end of the upper strands of the direction change folds are fixed in gaps between the guide hooks. The formation of the direction change fold includes executing a racking for the fiber bands in a direction change phase of the weft layer or diagonal layer, and spreading out and hanging next to one another the apexes of the change direction folds into a row of retainer needles arranged close together and mainly directed horizontally outwards, wherein the retainer needles are wrapped through lowering and raising of the guide elements to fix the apexes of the change direction folds. The formation of the upper strands of the direction change folds of a group includes inwardly moving a spreading edge of a stitch spreader, which is aligned parallel to a movement direction of the transport chains, from an outside position to directly above the retainer needles, such that the inward movement is crosswise to the movement direction of the transport chains and fixes the apexes in the gaps between the retaining needles, and moving the guide elements of the weft layers or diagonal layers, such that the upper strands are formed between the retainer needles and the guide elements of the weft layers or diagonal layers. During the execution of the racking, a width of the fiber bands is reduced, and, during the formation of the upper strand, the reduced width of the fiber bands is enlarged. Moreover, the formation of the upper strands further includes guiding cross sections of the upper strands of the direction change folds parallel to a plane of the retainer needles while generally keeping the sections of the fiber bands between the spreader edge and the guide elements pinned.

In accordance with a feature of the invention, the fiber arrangement can be conveyed to a pretreatment station.

According to another feature of the instant invention, the fiber bands may be composed of endless flat fiber bands.

Further, the fiber bands can be guided in a guide element aligned perpendicular to a preset laying direction.

According to the invention, the guide element for each fiber band can be arranged to cross the row of guide hooks of the transport chain.

Moreover, the spreader edge can be guided closely above the row of retainer needles in a positive manner from below and in an elastic manner from above, and the formation of the upper strand can further include moving the guide elements over the row of guide hooks while the fiber bands are braked on the transport chain between the spreader edge and a surface located at a distance in front of the row of guide hooks.

In accordance with still another feature of the present invention, the start of the lower strand and the end of the upper strand of the direction change fold may be fixed in the gaps between the needles of two rows of guide hooks immediately adjacent to one another.

According to still another feature, each individual fiber band, independent of the other fiber bands of the group, may be guided in the feed direction in front of the respective guide elements on the diagonal layer or weft layer across the width of the fiber bands under uniform tension and parallel to the respective guide element.

The invention is directed to an apparatus for laying fiber bands of filaments to form fiber arrangements. The apparatus includes a pair of endless moveable transport chains equipped with a double row of essentially vertically oriented needle-shaped guide hooks and with a row of retainer needles essentially horizontally oriented and arranged such that the mountings of the retaining needles are lower than foot sections of the guide hooks. The retainer needles are oriented outward for guiding and fixing direction change folds. Guide elements for at least one weft layer and/or diagonal layer are aligned perpendicularly to a laying direction of the fiber bands between the transport chains, which are structured and arranged to guide endless fiber bands. At least one creel with bobbins arranged to unwind tangentially to supply groups of fiber bands per weft layer and/or diagonal layer, and at least one stitch spreader structured and arranged to be guided and controlled outside the transport chains is assigned to each transport chain for each weft layer and/or diagonal layer. Each stitch spreader is structured and arranged to be guided in a displaceable manner generally within a customary movement area of the guide elements of the weft layer and/or diagonal layer and crosswise to a movement direction of the transport chains, and each stitch spreader includes a spreader edge aligned parallel to the transport chains that is movable from outside the assigned transport chain and over the retainer needles up to an area of the mountings. Further, each stitch spreader is structured to extend over an area of the direction change folds of the fiber bands.

According to a feature of the invention, the rows of guide hooks and the row of retainer needles may have a density of 15 to 30 needles per inch.

In accordance with another feature, the needles of at least one of the two rows of guide hooks and the retainer needles can have a flattened cross-section. The flattened cross-section may be oriented such that a largest extension is arranged crosswise to the movement direction of the transport chains.

According to still another feature of the instant invention, the weft layer and/or diagonal layer can include guide devices composed of at least one of separate guide pins and dowel pins, such that guide surfaces of the guide devices are parallelly aligned with the guide elements.

The creels can have at least one collarless deflection roller which is arranged at a distance of at least four bobbin widths behind a previous unwinding point.

According to another feature of the invention, at least one of conveyor or feed rollers and tension rolls may have a polygonal cross-section in a band storage of the fiber bands.

The invention is directed to a process of laying fiber bands of filaments between transport chains. The process includes guiding a filament from a first transport chain to a second transport chain, and fixing the fiber band at the second transport chain. The process also includes pulling the fiber band in a direction parallel to the second transport chain, lowering fiber band to a position below a retaining needle, pulling the fiber band in a direction parallel to the second transport chain while in a position below the retaining needle, and lifting the fiber band to a position above the retaining needle. The process also provides for holding a portion of the fiber band at the second transport chain, and, while holding the portion of the fiber band at the second transport chain, moving the fiber band toward the first transport chain.

According to a feature of the present invention, the second transport chain may include a row of retaining needles that includes the retaining needle, and the lowering of the fiber band, the pulling of the fiber band while below the retaining needle, and the lifting of the fiber band can fix the fiber band to the row of retaining needles.

Further, the second transport chain can include a double row of guide hooks, and the fiber band may be fixed at the second transport chain by the double row of guide hooks.

According to another feature of the invention, a stitch spreader having a spreader edge may be arranged to move in a direction crosswise to a length of the transport chains, and the spreader edge can be moved to hold the portion of the fiber band at the second transport chain.

In accordance with still yet another feature of the present invention, the fiber band can be guided by a guide element oriented perpendicularly to the retaining needle and may be movable along a length of the transport chain, crosswise to the transport chain, and vertically.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 6 illustrates a representation of the band guide and tensioning elements on the weft layer with a guide roller embodied in a polygonal manner, FIG. 7 illustrates a diagrammatic representation of the band course between the bobbin and the feed rollers;

FIG. 8 illustrates a partial plan view of FIG. 7 which shows the fiber band course between the unwinding point of the bobbin and the first guide roll; and FIG. 9 illustrates a tensioning roll of the band storage designed in a polygonal manner.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The laying device, as is used in particular for multiaxial thread arrangements, is composed of two transport chains 1 that can be moved at the side of the laying arrangement. These transport chains 1 as a rule move uniformly in the direction of a processing point which is usually the knitting point of a stitch-knitting machine. For each thread length of the arrangement a separate laying unit is provided, the weft layers or diagonal layers 2 of which move to and fro in different directions over the movement path of the two transport chains 1. No representation of this overall arrangement is provided. It is part of the generally known prior art.

Figure 1:
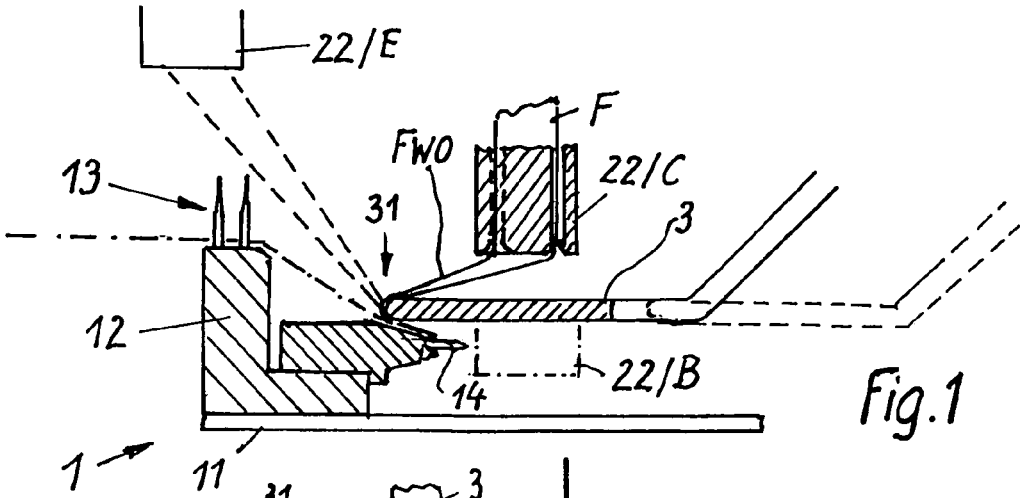
FIG. 1 illustrates a cross section through the area of a transport chain in which a direction change fold is formed by weft layers and stitch spreaders.

The arrangement of the guide elements 13 and retainer elements 14 on the transport chain 1 can be seen from FIG. 1. A mounting 12, here a two-part mounting, is located on a mounting plate 11 that is connected respectively with a chain link. Guide hooks 13 pointing upwards are arranged in the form of a double row in the perpendicular part of this mounting 12. The guide hooks 13 are relatively close together and have narrow gaps in the direction of the two needle rows. It is advantageous to arrange approx. 15 to 25 needles per inch. The arrangement of 20 needles per inch has proven effective.

The stem cross section of the needles of the guide hooks is advantageously flattened. The larger cross sections extend crosswise to the movement direction of the transport chains 1.

The retainer needles 14 are attached in the horizontal section of the mounting 12. The retainer needles 14 are arranged in a similarly dense manner and shaped like the needles of the guide hooks 13. However, these retainer hooks 14 are preferably aligned horizontally. It would also be possible to use them tilted upwards or downwards at an angle to the horizontal. However, the horizontal alignment has proven to be expedient particularly with respect to the production of the mountings.

A weft thread guide arranged on the weft layer or diagonal layer 2 is provided in the area of a laying arrangement The weft thread guide is here composed of a guide strip 21 in which the guide elements 22 are arranged. At least these guide elements 22 are movable in three directions; namely, firstly crosswise or diagonally to the transport chains for the laying movement, then in the longitudinal direction to the transport chains to carry out a racking and finally in the vertical direction for the defined hanging into the guide hooks 13 and into the retainer needles 14.

A stitch spreader 3 is arranged moveably horizontally from the outside inwards between the plane of the retainer needles 14 and a guide element 22 partially raised again. This stitch spreader 3 is shown in FIGS. 1 and 2 with its spreader edge 31 approximately in its most forward position.

Figure 2:
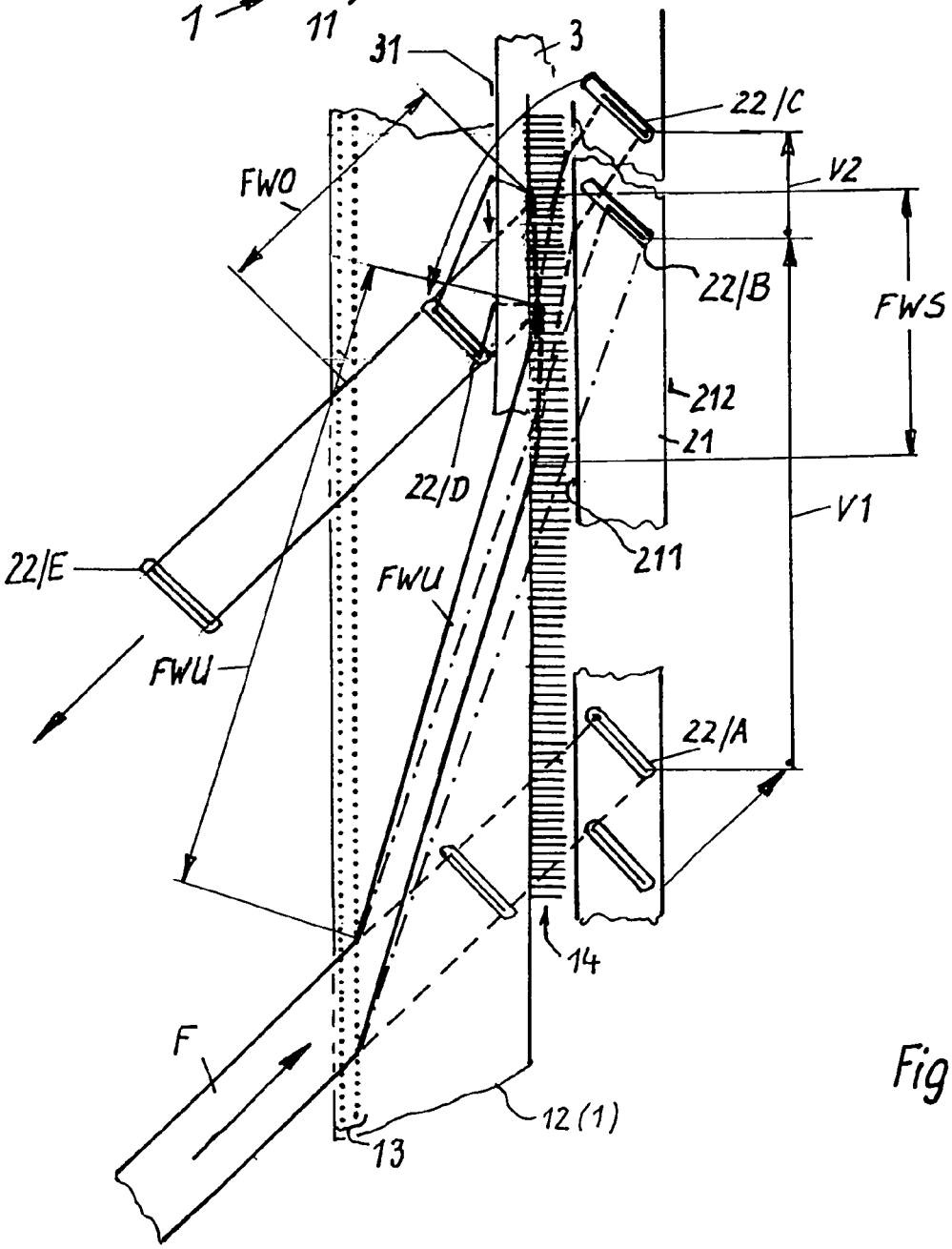
FIG. 2 illustrates a plan view of the device shown in FIG. 1, whereby the embodiment of the direction change fold is shown on the basis of several positions of a guide element of the weft layer or diagonal layer.

The example of FIG. 2 is to be used to describe the mode of operation of the device in the individual phases on the basis of a guide element 22/A through 22/E. Coming from the lower left, the guide element 22 first crosses the row of guide hooks 13 of the transport chain 1. The guide elements 22 are lowered behind this row of guide hooks 13 so that the fiber band F is fixed in a clamping manner in the row of guide hooks 13. When this operation has been completed, the racking V1 already starts in the longitudinal direction of the transport chain 1 during the retarding of the weft layer 2. The guide elements 22/A are still located above the plane of the retainer needles 14. When a part of the total racking—racking V1—has been completed, the guide strip 21 of the weft layer 2 with its guide elements 22 is lowered downwards.

The presser edge 211 or 212 of the guide strip 21 moves the fiber band F downwards. It is split by the tips of the retainer needles 14 and fixed in the gaps between the retainer needles 14 (position 22/B). After completing another racking V2 in this lowest position, the guide strip 21 with its guide elements 22/C is raised again. The fiber band is split again and placed in the gaps between the retainer needles 14. The movement of the weft layer 2 in the direction of the other transport chain 1 begins in this phase, so that the sections of the apex of the direction change fold FW are now finally fixed between the gaps of the retainer needles 14.

As soon as an adequate vertical space is available between the retainer needles 14 and the guide elements 22, the stitch spreader 3 with its spreader edge forwards is moved in the direction of the guide needle row 13, preferably with the aid of a control piston (not shown). With this movement the spreader 3 assists the spreading of the apex section FWS of the direction change fold into the gaps of the retainer needles 14. At the same time the spreader edge 31 holds the fibers of the upper strand FWO to the mounting 12 of the retainer needles 14. A tension is thus exerted on the outer fibers of the fiber band FWO, with the aid of which the fiber band F, which was displaced on one side into the guide elements 22 during the racking, is compensated again.

This is clearly discernible in the position of the guide element 22/D. At the same time the spreader edge 31 in this position ensures that the parts of the fiber band between the guide element 22 and this clamping edge remain under tension and free fiber parts accumulate outside the clamp line. The upper strand FWO of the direction change fold FW is thus spread out and moved under uniform tension over the row of guide hooks 13 in the direction of the other transport chain 1. This stretched section FWO of the fiber band F is aligned precisely horizontally and is thus fed to the guide hooks 13 at a uniform height. A particular lifting movement of the guide elements 22 is not initially provided for insertion into the row of the guide hooks 13. The necessity is determined by one skilled in the art on a case-by-case basis depending on the type of the fed fiber bands F.

Figure 3:
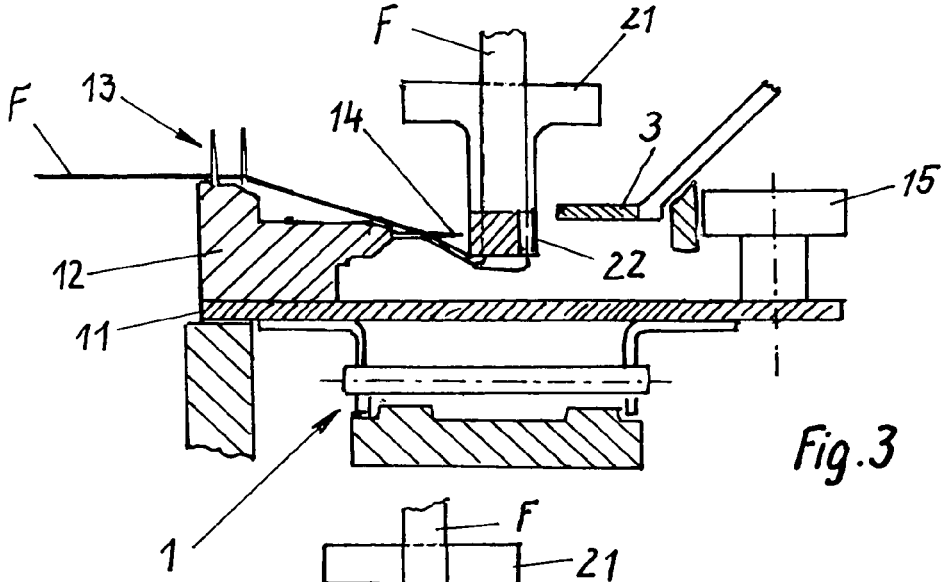
FIG. 3 illustrates a cross section similar to FIG. 1 in a position in which the guide elements of the weft layer hang the lower strand of the direction change fold into the row of retainer hooks.

FIG. 3 again shows the position of the working elements. This shown position corresponds approximately to the position 22/B of the guide element in FIG. 2. The first part of the racking V1 has been completed and the guide elements 22/B of the weft layer or the diagonal layer 2 are lowered with the presser edge 211 below the row of retainer needles 14. The stitch spreader 3 is still in the idle position.

Figure 4:
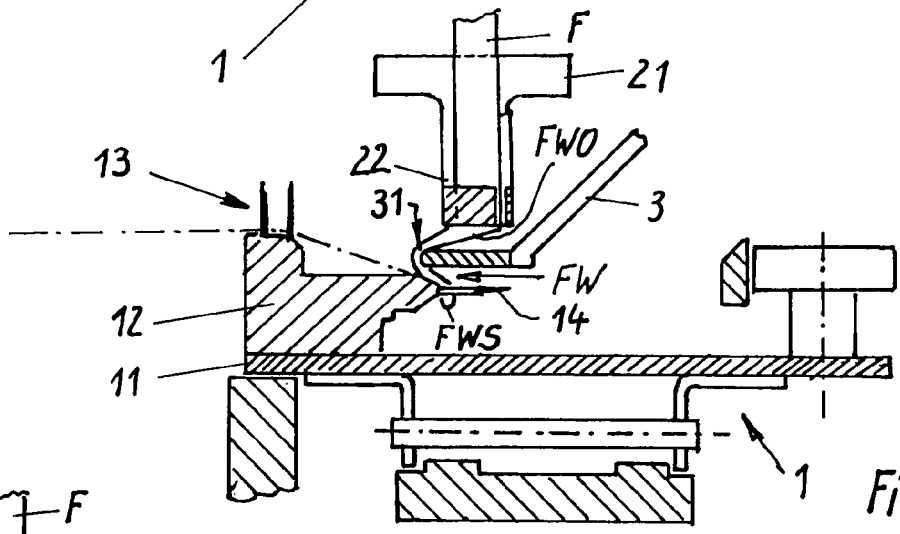
FIG. 4 illustrates a view analogous to FIG. 3 in a position in which the stitch spreader is inserted between the guide elements of the weft layer and the retainer hooks.

The position 22/C of FIG. 2 is shown in FIG. 4. The guide strip 21 of the weft layer or diagonal layer 2 has already been raised again with its guide element 22/C and is in the first phase of its movement to the row of guide hooks 13. The stitch spreader 3 has almost reached its final position. It clamps sections of the upper strand of the direction change fold FW to the mounting 12 of the retainer needles 14 and aligns the fiber band of the upper strand FWO horizontally.

Figure 5:
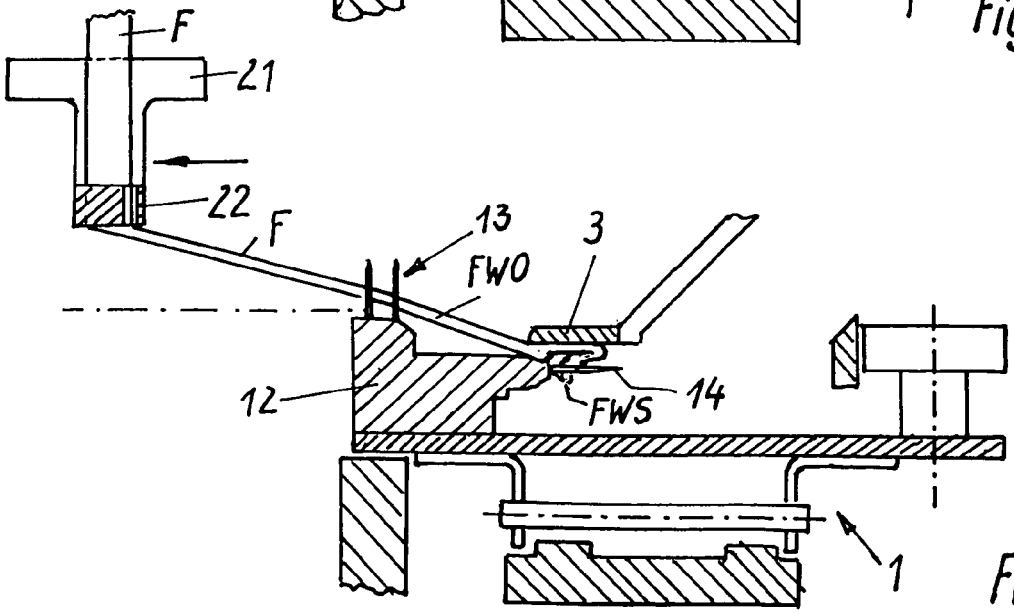
FIG. 5 illustrates a cross section according to FIG. 3 in which the upper strand of the direction change fold stretched between the stitch spreader and the guide element of the weft layer is transferred to the row of guide hooks.

FIG. 5 shows a subsequent position. After being raised again, the guide strip 21 of the weft layer or diagonal layer 2 has moved over the row of guide hooks 13 of the transport chain 1 and stretches the upper strand of the direction change fold FW held flat by the stitch spreader 3 such that the parts of the fiber band F are divided by the tips of the guide hooks 13 and the individual fiber ropes move into the gaps between the guide hooks 13 up to the base of the same. These bands are clamped there. Any loose sections in the area of the direction change fold FW are not displaced into the area of the thread arrangement between the transport chains 1.

It is particularly important that the fiber band F is always under tension on the weft layer 2 between the stitch spreader 3 and the guide element 22. This tension regularly present is supported by a tensioning arrangement known per se of guide pins 24 and dowel pins 23 above the guide elements on the weft layer 2. However, in contrast to the known prior art, this guide and tension arrangement is here provided individually for each fiber band F. Such a guide and tension arrangement is shown in FIG. 6. The guide pins 24 and the dowel pin 23 are aligned parallel to the guide surface in the guide elements 22. The dowel pin 23 is elastically pretensioned in the horizontal direction so that while forming a small fold it can temporarily store excess fiber band sections in the area of the direction change fold FW.

This parallel alignment of the guide elements also applies to the feed roller 4 that is located in the clearance above the movement area of the weft layer or diagonal layer 2 between the two transport chains 1. This feed roller 4, which is regularly difficult to access, is embodied as a so-called polygonal roller or as a roller with longitudinal ribs that are aligned along sheath lines. This embodiment is intended to ensure that fibers detaching individually from the bundle of the fiber band F do not wrap around this feed roller 4.

The diagram of the feed of a fiber band from the bobbin up to the feed roller 4 is shown in FIG. 7. The bobbin 8 guided on a horizontal axis in a creel is braked slightly by the brake 9. From the unwinding point of the band, the band is guided over a large distance, which can be up to several meters, to a broad, collarless first guide roll 7 on which the fiber band F can be displaced laterally depending on the respective unwinding point on the bobbin 8 (cf. FIG. 8). The upper strand of this band loop forming here is then likewise guided over a great distance to a second deflecting roller or to feeder rolls 6. A strong lateral deflection of the fiber band F is thus reliably prevented.

The feeder rolls 6 have three driven delivery rollers that draw off the fiber bands F at a steady speed from the bobbins 8. The bobbins 8 belonging to feeder rolls 6 are staggered with respect to one another in the creel along their axes such that without lateral guiding their fiber bands position themselves with suitable spacing laterally on the delivery rollers.

The different unwinding speeds necessary due to the laying operation and the fiber band excesses at times caused thereby are stored in the area of the band storage 5. To ensure the spread out position of the fiber band also on the tension roll 51 provided with lateral collars, the tension roll has a polygonal face for the fiber band F. This is formed here by individual pins arranged in a ring-shaped manner (cf. FIG. 9).

The arrangement and design of the guide elements in the area of the creel has proven effective. The number of twists in the band that can develop unintentionally has thus been substantially reduced.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

| List of Reference Numbers | |
|---|---|
| 1 | Transport chain |
| 11 | Mounting plate |
| 12 | Mounting |
| 13 | Guide hooks, double row |
| 14 | Retainer hooks |
| 15 | Support roll |
| 2 | Weft layer or diagonal layer |
| 21 | Guide strip |
| 211, 212 | Presser edge |
| 22 (A, B, C, D, E) | Guide element |
| 23 | Dowel pin |
| 24 | Guide pins |
| 3 | Stitch spreader |
| 31 | Spreader edge |
| 4 | Feed roller |

-continued

| List of Reference Numbers | |
|---|---|
| 5 | Band storage |
| 51 | Tension roll |
| 6 | Feeder rolls |
| 7 | Guide roll |
| 8 | Bobbin |
| 9 | Brake |
| A, B, C, D, E | Positions of a guide element in the turning phase |
| F | Fiber band |
| FG | Fiber band sheet |
| FW | Direction change fold |
| FWU | Lower strand |
| FWS | Apex |
| FWO | Upper strand |
| V1 | Racking (before insertion into the retainer hooks) |
| V2 | Racking (after insertion into the retainer hooks) |

What is claimed:

1. A process for laying fiber bands of filaments to form fiber arrangements via changeably moveable weft layers or diagonal layers composed of fiber bands that are stretched in different laying directions between two transport chains equipped with guide hooks and retainer needles, said process comprising:

individually spreading the fiber bands, which are guided by guide elements of the weft layer or diagonal layer, crosswise over both transport chains;

depositing the fiber bands onto the transport chains;

forming into each of the fiber bands a direction change fold that has a lower strand, an upper strand and an apex, wherein a start of the lower strands and an end of the upper strands of the direction change folds are fixed in gaps between the guide hooks;

the formation of the direction change fold comprising:

executing a racking for the fiber bands in a direction change phase of the weft layer or diagonal layer; and spreading out and hanging next to one another the apexes of the change direction folds into a row of retainer needles arranged close together and mainly directed horizontally outwards, wherein the retainer needles are wrapped through lowering and raising of the guide elements to fix the apexes of the change direction folds; and the formation of the upper strands of the direction change folds of a group comprising:

inwardly moving a spreading edge of a stitch spreader, which is aligned parallel to a movement direction of the transport chains, from an outside position to directly above the retainer needles, such that the inward movement is crosswise to the movement direction of the transport chains and fixes the apexes in the gaps between the retaining needles; and moving the guide elements of the weft layers or diagonal layers, such that the upper strands are formed between the retainer needles and the guide elements of the weft layers or diagonal layers, wherein, during the execution of the racking, a width of the fiber bands is reduced, and, during the formation of the upper strand, the reduced width of the fiber bands is enlarged; and guiding cross sections of the upper strands of the direction change folds parallel to a plane of the retainer needles while generally keeping the sections of the fiber bands between the spreader edge and the guide elements pinned.

2. The process in accordance with claim 1, wherein the fiber arrangement is conveyed to a pretreatment station.

3. The process in accordance with claim 1, wherein the fiber bands are composed of endless flat fiber bands.

4. The process in accordance with claim 1, wherein the fiber bands are guided in a guide element aligned perpendicular to a preset laying direction.

5. The process in accordance with claim 1, wherein the guide element for each fiber band is arranged to cross the row of guide hooks of the transport chain.

6. The process in accordance with claim 1, wherein the spreader edge is guided closely above the row of retainer needles in a positive manner from below and in an elastic manner from above, and the formation of the upper strand further comprises moving the guide elements over the row of guide hooks while the fiber bands are braked on the transport chain between the spreader edge and a surface located at a distance in front of the row of guide hooks.

7. The process in accordance with claim 1, wherein the start of the lower strand and the end of the upper strand of the direction change fold are fixed in the gaps between the needles of two rows of guide hooks immediately adjacent to one another.

8. The process in accordance with claim 1, wherein each individual fiber band, independent of the other fiber bands of the group, is guided in the feed direction in front of the respective guide elements on the diagonal layer or weft layer across the width of the fiber bands under uniform tension and parallel to the respective guide element.

9. An apparatus for laying fiber bands of filaments to form fiber arrangements, comprising:

a pair of endless moveable transport chains equipped with a double row of essentially vertically oriented needle-shaped guide hooks and with a row of retainer needles essentially horizontally oriented and arranged such that the mountings of the retaining needles are lower than foot sections of the guide hooks, wherein said retainer needles are oriented outward for guiding and fixing direction change folds, guide elements for at least one weft layer and/or diagonal layer aligned perpendicularly to a laying direction of the fiber bands between said transport chains, which are structured and arranged to guide endless fiber bands;

at least one creel with bobbins arranged to unwind tangentially to supply groups of fiber bands per weft layer and/or diagonal layer;

at least one stitch spreader structured and arranged to be guided and controlled outside said transport chains being assigned to each transport chain for each weft layer and/or diagonal layer;

each said stitch spreader is structured and arranged to be guided in a displaceable manner generally within a customary movement area of said guide elements of the weft layer and/or diagonal layer and crosswise to a movement direction of said transport chains;

each said stitch spreader comprises a spreader edge aligned parallel to said transport chains that is movable from outside said assigned transport chain and over said retainer needles up to an area of said mountings; and each said stitch spreader being structured to extend over an area of the direction change folds of the fiber bands.

10. The apparatus in accordance with claim 9, wherein said rows of guide hooks and said row of retainer needles have a density of 15 to 30 needles per inch.

11. The apparatus in accordance with claim 9, wherein said needles of at least one of said two rows of guide hooks and said retainer needles have a flattened cross-section.

12. The apparatus in accordance with claim 11, wherein said flattened cross-section is oriented such that a largest extension is arranged crosswise to the movement direction of said transport chains.

13. The apparatus in accordance with claim 9, wherein the weft layer and/or diagonal layer comprises guide devices composed of at least one of separate guide pins and dowel pins, such that guide surfaces of said guide devices are parallelly aligned with the guide elements.

14. The apparatus in accordance with claim 9, wherein said creels have at least one collarless deflection roller which is arranged at a distance of at least four bobbin widths behind a previous unwinding point.

15. The apparatus in accordance with claim 9, wherein at least one of conveyor or feed rollers and tension rolls have a polygonal cross-section in a band storage of the fiber bands.

16. The process of laying fiber bands of filaments between transport chains, comprising:

guiding a filament from a first transport chain to a second transport chain;

fixing the fiber band at the second transport chain;

pulling the fiber band in a direction parallel to the second transport chain;

lowering fiber band to a position below a retaining needle;

pulling the fiber band in a direction parallel to the second transport chain while in a position below the retaining needle;

lifting the fiber band to a position above the retaining needle;

holding a portion of the fiber band at the second transport chain; and while holding the portion of the fiber band at the second transport chain, moving the fiber band toward the first transport chain.

17. The process in accordance with claim 16, wherein the second transport chain comprises a row of retaining needles that includes the retaining needle, and wherein the lowering of the fiber band, the pulling of the fiber band while below the retaining needle, and the lifting of the fiber band fixes the fiber band to the row of retaining needles.

18. The process in accordance with claim 16, wherein the second transport chain comprises a double row of guide hooks, and the fiber band is fixed at the second transport chain by the double row of guide hooks.

19. The process in accordance with claim 16, wherein a stitch spreader having a spreader edge is arranged to move in a direction crosswise to a length of the transport chains, and the spreader edge is moved to hold the portion of the fiber band at the second transport chain.

20. The process in accordance with claim 16, wherein the fiber band is guided by a guide element oriented perpendicularly to the retaining needle and movable along a length of the transport chain, crosswise to the transport chain, and vertically.

* * * * *